United States Patent [19]

Roy

[11] Patent Number: 4,749,297

[45] Date of Patent: Jun. 7, 1988

[54] LOOSE-LEAF BINDER AND PAPER-PUNCH COMBINATION

[75] Inventor: Normand L. Roy, Gatineau, Canada

[73] Assignee: Novator International Inc., Aylmer, Canada

[21] Appl. No.: 17,853

[22] Filed: Feb. 24, 1987

[51] Int. Cl.[4] ..... B42F 13/40

[52] U.S. Cl. ..... 402/1

[58] Field of Search ..... 402/1, 31, 32, 33, 39, 402/41, 79; D19/78

[56] References Cited

U.S. PATENT DOCUMENTS

| | | | |
|---|---|---|---|
| 531,887 | 1/1895 | Wilkes | 402/1 |
| 956,216 | 4/1910 | Spiro | 402/1 |
| 1,603,538 | 10/1926 | Helfer . | |
| 1,623,824 | 4/1927 | Bondeson et al. | 402/1 |
| 2,139,159 | 12/1938 | Hammen . | |
| 3,349,774 | 10/1967 | Ryan . | |
| 3,944,373 | 3/1976 | Farjon et al. . | |
| 3,975,105 | 8/1976 | Cline . | |
| 4,552,478 | 11/1985 | Cohen | 402/31 |

FOREIGN PATENT DOCUMENTS

| | | | |
|---|---|---|---|
| 284622 | 10/1965 | Australia | 402/1 |
| 256490 | 12/1925 | Canada . | |
| 766092 | 10/1967 | Canada . | |
| 1002742 | 1/1977 | Canada . | |
| 1097952 | 1/1961 | Fed. Rep. of Germany | 402/1 |
| 2947367 | 5/1981 | Fed. Rep. of Germany | 402/1 |
| 42583 | 2/1914 | Sweden | 402/1 |
| 1531891 | 11/1978 | United Kingdom . | |

*Primary Examiner*—Paul A. Bell

[57] ABSTRACT

A loose-leaf binder has a paper punch which is actuated by the opening of the binder rings. The arms of the rings are attached to two hinge plates which pivot as the arms are opened and closed. Male and female punch die members on the underside of the hinge plates are brought together when the binder rings are opened, to punch a sheet of loose-leaf paper.

5 Claims, 4 Drawing Sheets

LOOSE-LEAF BINDER AND PAPER-PUNCH COMBINATION

BACKGROUND OF THE INVENTION

This invention relates to a unitary loose-leaf binder and paper-punch.

A problem commonly encountered by users of loose-leaf binders is the absence of any convenient means for punching the paper to be held in the binder. Separate paper-punches are sold but these are often expensive and cumbersome and in any case, are often not conveniently available to many users of loose-leaf binders, such as school and university students. Although pre-punched paper is sold and widely used, users of loose-leaf binders are often given paper which the users wish to retain in the binder but which is not pre-punched. Such users often jab holes in the paper by forcing it over the arms of the binder, but paper thus inserted in a binder looks messy, does not move freely on the binder rings and is often askew. It is therefore desirable to provide a loose-leaf binder with an integral paper-punch, so that the punch will always be available when paper is to be inserted into the binder.

Attempts have been made to provide such devices. U.S. Pat. No. 3,349,774, issued Oct. 31, 1967 to J. W. Ryan describes a mechanism in which paper can be punched when the binder rings are closed. One drawback with this design is that the punch die members are positioned within the area bounded by the binder rings, thus cluttering up the binder rings and giving the open binder an unattractive appearance. Binders are frequently opened and closed simply to add pre-punched paper, and a user does not want to see a prominent punch mechanism at these times, when it is not needed.

Another combined loose-leaf binder and paper-punch is described in U.S. Pat. No. 2,139,159, issued on Dec. 6, 1938 to C. B. Hammen. In this case the punch mechanism is concealed, but the spine of the ring binder mechanism and all the paper held on the rings must be swung to one side to operate the punch.

SUMMARY OF THE INVENTION

The unitary loose-leaf binder and paper-punch of the present invention has a concealed paper-punch mechanism, and thus has the appearance of a standard binder. The punch mechanism operates by means of the opening of the rings, so that whenever the rings are opened, the punch is actuated.

Ordinary loose-leaf binder mechanisms well-known in the art have two hinge plates which pivot along their adjacent edges. The hinge is concealed under a cover which engages the outer edge of the hinge plates. Mating arms are attached to the hinge plates, each arm forming one half of a ring. As the hinge plates pivot, the arms open and close. In the present invention, a punching mechanism comprising a male punch die member and a female die opening (one pair for each hole to be punched) is located on the underside of the hinge plates. The male punch die member penetrates the female die opening when the binder arms are opened, punching a sheet of paper positioned between the male and female die elements. The paper is released when the binder arms are closed. The components forming the rings, hinge and hinge cover, (as well as the binder case itself), are standard parts ordinarily used for loose-leaf binders, so that manufacturing costs are minimized.

BRIEF DESCRIPTION OF THE DRAWINGS

In drawings which illustrate embodiments of the invention.

DETAILED DESCRIPTION OF THE PREFERRED EMBODIMENT

Figure 1:
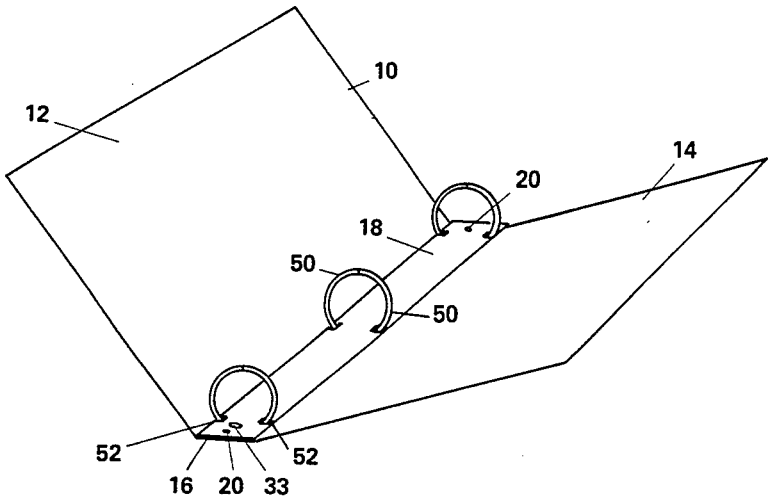
FIG. 1 is a perspective view of one embodiment, of the unitary loose-leaf binder and paper-punch combination according to the invention, including the binder case.

Referring to FIG. 1 of the drawings, a unitary loose-leaf binder and paper-punch combination includes a binder case 10 having front and back covers 12 and 14 respectively and side panel 16. The unitary loose-leaf binder and paper-punch means 18 are affixed to the binder case 10 by rivets 20. In this specification "unitary loose-leaf binder and paper-punch combination" refers to the complete assembly, including the binder case, whereas "unitary loose-leaf binder and paper-punch means" refers to the mechanism only, not including the binder case 10. The binder case 10 is a well-known, standard article which will not be further described herein. In FIG. 1, the unitary loose-leaf binder and paper-punch means 18 is shown affixed to side panel 16 of binder case 10, but it may equally well be affixed to back cover 14.

The unitary loose-leaf binder and paper-punch means 18 has two hinge plates 22, 23 having outer edges 24 and 26 and inner edges 28 and 30. The inner edges, 28, 30 of hinge plates 22, 23 are kept in operative association by a plurality of tab means 38, 40 on the upper side of inner edges 30 and 28 respectively, by a plurality of tab means 39, 41 on the lower side of these edges, and by means of cover 32 whose lips 34, 36 engage the outer edges 26 and 24 respectively of hinge plates 22 and 23. A space 44 is formed between cover 32 and hinge plates 22, 23. A plurality of arms 50 is affixed to hinge plates 22, 23. The arms 50 are positioned to form mating pairs such that a closed binding ring may be formed by each pair of arms 50. Each arm has a free end 51. When the arms 50 are in the closed position, the free ends 51 of each mating pair of arms 50 are touching each other. The tips of the free ends may be shaped to interlock with one another according to designs well-known in the art. The preferred embodiment illustrated shows three pairs of mating arms 50, but other numbers of pairs may be used if desired. Openings 52 in hinge cover 32 permit the movement of arms 50 from a closed to an opened position, as described below.

Figure 3:
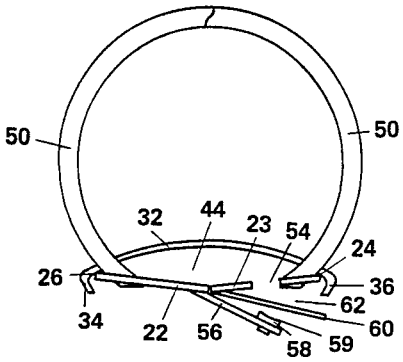
FIG. 3 is a section of the line III—III of FIG. 2.
Figure 4:
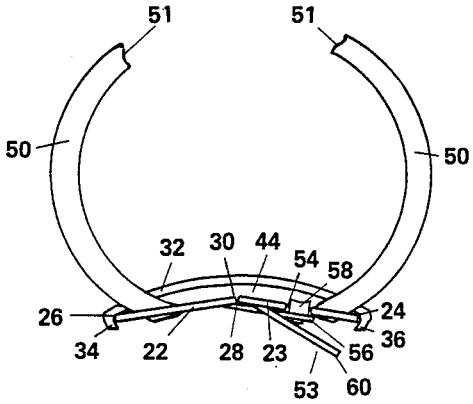
FIG. 4 shows the section of FIG. 3, but with the binder in the open position.
Figure 5:
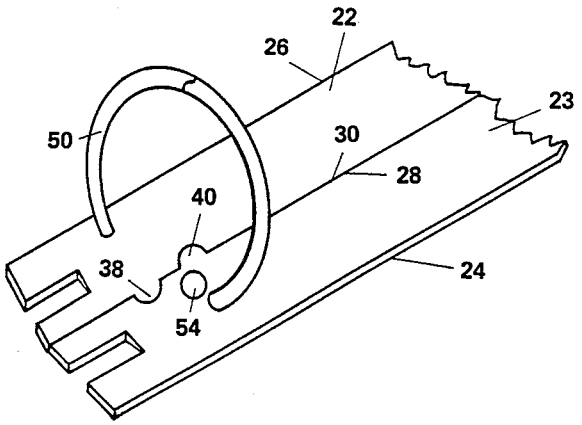
FIG. 5 is a perspective view of a portion of the top of the hinge plates, the hinge cover being removed.
Figure 6:
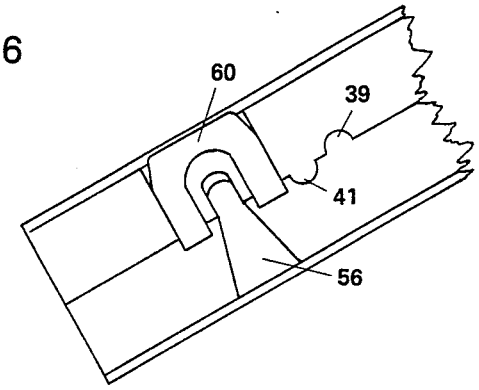
FIG. 6 is a perspective view of the embodiment of FIG. 2 showing a portion of the underside of the embodiment.
Figure 7:
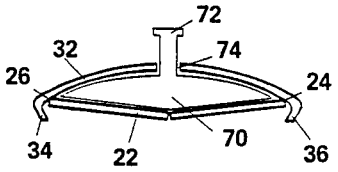
FIG. 7 is a section of the line VII—VII of FIG. 2 showing the paper disc barrier in the engaged position.
Figure 8:
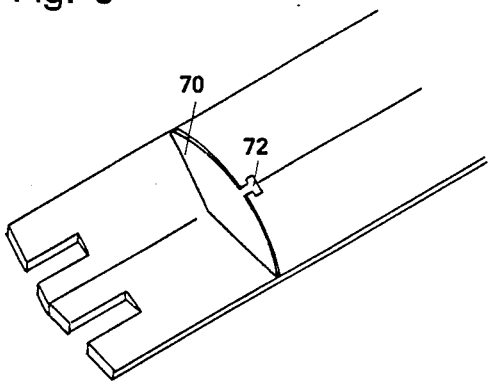
FIG. 8 is a plan view of the paper disc barrier in the engaged position shown in FIG. 7.
Figure 9:
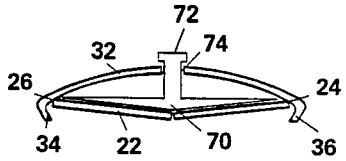
FIG. 9 is a section of the line VII—VII of FIG. 2 showing the paper disc barrier in the disengaged position.
Figure 10:
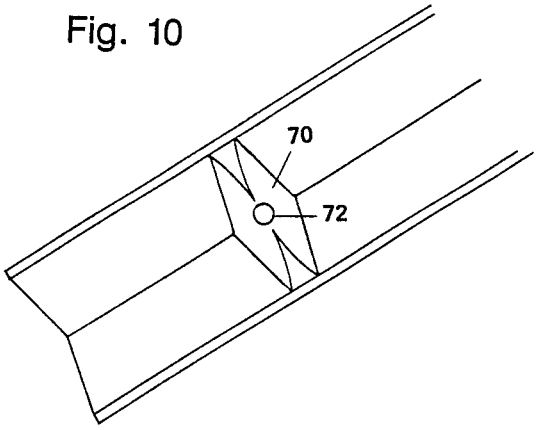
FIG. 10 is a plan view of the paper disc barrier in the disengaged position shown in FIG. 9.

The paper-punch means, generally designated 53 in FIG. 4, will now be described. Hinge plate 23 has a plurality of female die openings 54. Affixed to hinge plate 22 is male punch die member 56 having head 58. The diameter of the tip of head 58 is matched with the diameter of female die opening 54 so that a sheet of paper positioned between head 58 and opening 54 will be punched when head 58 penetrates opening 54. Head 58 is formed with spherical radius 59 at its tip; it is tapered outwardly in the direction of the tip, as shown in FIG. 3. The shaping of punching heads for optimal punching of paper is well-known in the art.

Figure 2:
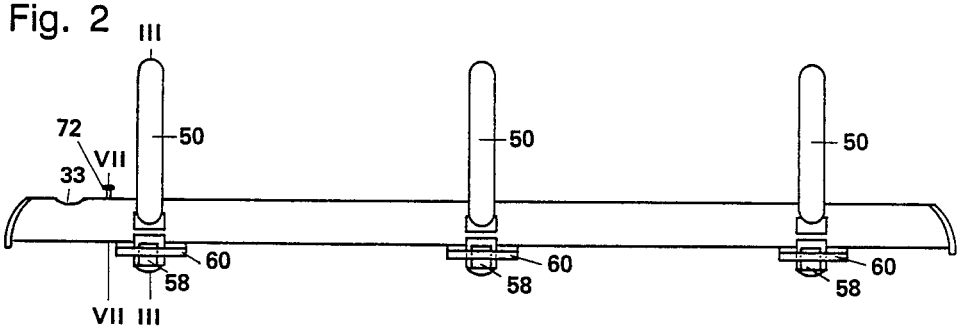
FIG. 2 is an elevation of one embodiment of the unitary loose-leaf binder and paper-punch means.

In the embodiment illustrated, paper-punch means 53 is directly aligned with arms 50, female die openings 54 being positioned directly between the bases of each pair of arms 50. If desired, punch means 53 may be offset somewhat from arms 50, i.e. all moved to the left or right from the positions shown in FIG. 2.

Loose-leaf paper is held in position for punching by holding means 60 which is affixed to hinge plate 23. In the embodiment illustrated, one holding means 60 is positioned about each female die opening 54, but many shapes of holding means 60 are possible. Additional holding means 60 may be used if desired.

In the embodiment illustrated, female die openings 54 are formed in hinge plate 23. However, it is possible for holding means 60 to be configured so that a portion of it lies flat against hinge plate 23 and the female die openings are in the said portion of the holding means, rather than the hinge plate itself. In this embodiment (not illustrated) there are holes in the hinge plate immediately behind the female die openings and somewhat larger in diameter than the female die openings to permit unimpeded passage of the heads 58 through the female die openings.

There are the same number of paper-punch means 53 as pairs of arms 50. The spacing between adjacent paper-punch means 53 is the same as that between adjacent pairs of arms 50, so that a sheet of paper punched by the punch means 53 can then be placed on the arms 50 and held in place in the usual manner when the arms 50 are closed.

In use, a sheet of loose-leaf paper to be punched is put in the space indicated as 62 in FIG. 3 between holding means 60 and hinge plate 23, the arms 50 being in the closed position. The arms 50 are then moved to the open position shown in FIG. 4. This movement may be achieved by pulling outwardly on a pair of arms 50. As arms 50 are opened the hinge plates 22, 23 are pivoted about their inner edges 30, 28. In the fully open position, the upper surface of hinge plates 22, 23 adjacent their inner edges 30, 28 touch the inner surface of hinge cover 32. The pivoting movement of hinge plates 22, 23 causes male punch die members 56 to pivot toward hinge plate 23, causing head 58 to penetrate female die opening 54, punching the sheet of loose-leaf paper. The arms 50 are then moved to the closed position by pressing inwardly on arms 50. This causes male punch die member 56 to pivot away from hinge plate 23, withdrawing head 58 from female die opening 54. As male punch die member 56 pivots to a position below holding means 60, as shown in FIG. 3, the loose-leaf paper is retained on the upper surface of holding means 60, permitting the head 58 to withdraw from the hole punched in the paper, thus releasing the sheet of loose-leaf paper. Holding means 60 thus serves the dual function of holding the paper to be punched in the proper position, and facilitating the withdrawal of head 58 from the punched paper.

The discs of paper punched out of the loose-leaf paper remain in space 44 between hinge plates 22, 23 and hinge cover 32. Stops (not shown) can be provided on the upper side of hinge plates 22, 23 or the underside of hinge cover 32 to prevent hinge plates 22, 23 from contacting the hinge cover when the arms 50 are in the open position. This provides a larger storage space 44 so that more discs of paper can accumulate before hampering the pivoting movement of the hinge plates 22, 23.

Flexible or compressible barriers 70 are located in space 44 at both ends of the hinge cover 32 so as to form a closed reservoir. As shown in FIGS. 7 to 10 the barrier 70 may be disengaged by pressing knob 72 which projects through opening 74 in hinge cover 32. This permits paper discs to be removed through hole 33 when the mechanism is shaken in a suitable orientation.

In binder mechanisms in which lever means are used to pivot the hinge plates, openings at the ends of the hinge plates are provided to permit the operation of the levers. In such mechanisms, hole 33 is not required, as the paper discs can be removed through the said openings in the hinge plates.

The paper disc barriers in space 44 can be of a simpler design which cannot be disengaged, and the hole through which the paper discs could be removed would then be positioned between the barriers. In this case hole 33 would be fitted with a removeable plug which could be removed when the paper discs were to be emptied from storage space 44.

Many modifications to the preferred embodiment are possible, and will be apparent to persons skilled in the art. For example, more or fewer punches than rings may be used if desired. The positions of the male and female punch die members may be reversed, the female die opening being in the place of punch head 58 and vice versa. Lever means can be provided to pivot the hinge plates 22, 23 to open the arms 50, according to designs known in the art.

These and other modifications will readily occur to persons skilled in the art and are included in the scope of the invention. No limitations as to details of the design are intended other than those in the following claims.

I claim:

1. A unitary loose-leaf binder and paper-punch means comprising:

two hinge plates having adjacent edges and outer edges, said hinge plates being pivotal about said adjacent edges;

a plurality of pairs of mating, generally arcuate arms, one arm of each pair being rigidly affixed to one of said hinge plates, and one end of the mating arm of each pair of said arms being rigidly affixed to the other of said hinge plates, each arm having a free end;

a hinge cover over said hinge plates which operatively engages the said outer edges of the said hinge plates;

said hinge plates being pivotal about their adjacent edges from a first position, in which the free end of each arm is closed upon the free end of its mating arm, to a second position, in which the free end of each arm is spaced apart from the free end of its mating arm;

one of said hinge plates bearing a plurality of female die openings;

the other of said hinge plates having a plurality of male punching die means fixed thereon in position to penetrate said female die openings when said hinge plates are moved from the said first position to the said second position.

2. A unitary loose-leaf binder and paper-punch means according to claim 1 further comprising means for holding a sheet of paper to be punched.

3. A unitary loose-leaf binder and paper-punch means according to claim 1 or 2 further comprising a barrier positioned adjacent each end of the said hinge cover to form a closed reservoir bounded by the said hinge plates, hinge cover and barriers, at least one of said barriers being openable to permit punched-paper discs to be removed from the said reservoir.

4. A unitary loose-leaf binder and paper-punch means according to claim 1 or 2 further comprising a barrier positioned adjacent each end of the said hinge cover to form a closed reservoir bounded by said hinge plates, hinge cover and barriers, wherein said hinge cover has a hole for removal of punched-paper discs from said reservoir.

5. A unitary loose-leaf binder and paper-punch according to claim 1 or 2 further comprising a binder case and means to fasten the unitary loose-leaf binder and paper-punch to said binder case.

* * * * *